US010285518B1

(12) United States Patent
Nekhala

(10) Patent No.: US 10,285,518 B1
(45) **Date of Patent: *May 14, 2019**

(54) SHEET BED TIGHTENER

(71) Applicant: Jack Nekhala, Linden, NJ (US)

(72) Inventor: Jack Nekhala, Linden, NJ (US)

( * ) Notice: Subject to any disclaimer, the term of this patent is extended or adjusted under 35 U.S.C. 154(b) by 262 days.

This patent is subject to a terminal disclaimer.

(21) Appl. No.: 15/293,802

(22) Filed: Oct. 14, 2016

Related U.S. Application Data

(63) Continuation of application No. 15/056,442, filed on Feb. 29, 2016, now Pat. No. 9,492,022.

(51) Int. Cl.
*A47G 9/04* (2006.01)
*A47G 9/02* (2006.01)

(52) U.S. Cl.
CPC ..... *A47G 9/04* (2013.01); *A47G 9/0246* (2013.01); *A47G 9/0238* (2013.01)

(58) Field of Classification Search
CPC ..... A47G 9/02; A47G 9/0238; A47G 9/0246; A47G 9/0292; A47G 9/04
See application file for complete search history.

(56) References Cited

U.S. PATENT DOCUMENTS 2,886,833 A * 5/1959 Enger ..... A47C 31/105 5/496
4,495,233 A * 1/1985 Bassetti ..... A47G 9/0246 428/102
4,642,826 A * 2/1987 Bassetti ..... D05B 25/00 5/496
4,727,608 A * 3/1988 Joyce ..... A47G 9/0246 24/712
4,777,894 A * 10/1988 Joyce ..... A47G 9/0246 112/475.06
4,970,744 A * 11/1990 Davis ..... A47G 9/0246 5/496
5,020,177 A * 6/1991 Etherington ..... A47G 9/02 5/496
5,628,077 A * 5/1997 Briganti ..... A47G 9/0246 5/496
6,108,837 A * 8/2000 Knebel, III ..... A47C 21/022 24/457
7,703,156 B2 * 4/2010 Lee ..... A47C 31/10 219/212
8,074,313 B2 * 12/2011 Marcangelo ..... A47C 21/022 5/690
8,458,837 B2 * 6/2013 Marcangelo ..... A47C 31/00 5/690
8,607,383 B2 * 12/2013 Briganti ..... A47G 9/0246 5/496

(Continued)

*Primary Examiner* — Robert G Santos
(74) *Attorney, Agent, or Firm* — Michael J. Feigin, Esq.; Feigin and Fridman LLC

(57) ABSTRACT

A cord with an outer fabric covering over a sheath and draw string is used to secure a sheet to a bed. The cord has a series of clips attached there-to by a second cord or by direct attachment. The clips are in turn removably attachable to edges of a sheet. One then tightens the draw string, reducing the length of the cord, and continues to do so until the sheet is pulled to a bottom side of the mattress. In this manner, the sheet ends are beneath the mattress and tightened thereto by the cord. The cord further snaps to itself, in embodiments of the disclosed technology, to form a closed loop around the bed.

18 Claims, 8 Drawing Sheets

(56) References Cited

U.S. PATENT DOCUMENTS 8,856,984 B1 * 10/2014 Donham ..... A47G 9/0246 5/496
8,856,985 B2 * 10/2014 Rensink ..... A47C 21/02 5/482
9,492,022 B2 * 11/2016 Nekhala ..... A47G 9/0246
9,545,164 B2 * 1/2017 Tulloch ..... A47G 9/0246
10,104,981 B2 * 10/2018 Nekhala ..... A47G 11/004
2002/0116763 A1 * 8/2002 Weir ..... A47G 9/0246 5/504.1
2003/0019037 A1 * 1/2003 Michaelis ..... A47G 9/02 5/497
2004/0060113 A1 * 4/2004 Lantagne ..... A47C 21/022 5/494
2008/0028522 A1 * 2/2008 Atwood ..... A47G 9/0246 5/496
2008/0155749 A1 * 7/2008 Stevens ..... A47G 9/0246 5/496
2008/0289104 A1 * 11/2008 Rowson ..... A47G 9/02 5/482
2009/0126109 A1 * 5/2009 Lee ..... A47C 31/10 5/421
2010/0269743 A1 * 10/2010 Marcangelo ..... A47C 21/022 112/2.1
2011/0131724 A1 * 6/2011 Marcangelo ..... A47C 31/00 5/498
2012/0324646 A1 * 12/2012 Briganti ..... A47G 9/0246 5/496
2013/0192001 A1 * 8/2013 Rensink ..... A47C 21/02 5/691
2013/0254990 A1 * 10/2013 Kim ..... A47G 9/0246 5/497
2014/0150181 A1 * 6/2014 Tulloch ..... A47G 9/0246 5/496
2016/0007774 A1 * 1/2016 Kakabeeke ..... A47G 9/0246 5/496
2016/0174738 A1 * 6/2016 Nekhala ..... A47G 9/0246 5/496
2017/0035210 A1 * 2/2017 Nekhala ..... A47G 11/004

* cited by examiner

SHEET BED TIGHTENER

FIELD OF THE DISCLOSED TECHNOLOGY

The disclosed technology relates generally to sheets for beds and, more specifically, to a tightening device for securing a fitted or unfitted sheet to a mattress.

BACKGROUND OF THE DISCLOSED TECHNOLOGY

There are, generally speaking, two different types of bed sheets commonly purveyed in the market. There are "fitted sheets," which have a built in elastic other structure to hold a sheet to a bed, and there are "unfitted sheets," which comprise a layer of fabric to be tucked under the corners of a mattress, or the like. Fitted sheets typically follow the contours of a specific bed more than do unfitted sheets. The former is designed to contract around the contours of a mattress, while the latter is typically tucked under the mattress as tightly as possible. Ira both cases, one usually must lift at least the corners of the bed and tuck the fabric between a base of a bed and a mattress. This can be strenuous work and is difficult for those of little strength, such as the elderly or handicapped. Further, for hotels, hospitals, and the like, time spent by employees in making up beds is expensive.

What is needed in the art is a way to have a tightly fitting sheet around a bed which is simple to manufacture, inexpensive to procure, and which reduces the time spent in covering a bed with a sheet.

SUMMARY OF THE DISCLOSED TECHNOLOGY

An object of the disclosed technology is to secure a bed sheet, whether fitted or unfitted, to a mattress or bed. In a method of doing so, this is accomplished by covering a mattress or part of a bed with a fabric sheet by placing the fabric sheet of a top side of the mattress with at least some of the fabric sheet draped over at least one of a front, back, left and right side of the mattress. Then one wraps a continuous cord with draw string around each of the front, back, left, and said right side of the bed and connects the sheet to the cord via removably connectable cords. At least one such cord is adjacent to (closest to)/abutting each cardinal side of the bed or the equivalent. Then one pulls the draw string (further) out of the continuous cord, causing the cord to decrease in length until the fabric sheet covers (completely) the front, back, left, and right side of the bed.

In embodiments of the disclosed technology, one pulls until the cord is completely adjacent to (defined as "closed to, compared to other sides," where a "side" extends to all edges having at least a 30 degree, 45 degree, or 90 degree change in direction) a bottom side of the bed, the bottom side being opposite the top side. The step of pulling continues, in embodiments of the disclosed technology, until the fabric sheet itself covers at least a portion of the bottom side of the bed. In the step of "placing," the placing can be over each respective side of the bed (between the top and bottom sides).

The cord has an outer fabric layer covering an elastic layer which, in turn, covers a hollow portal, in embodiments of the disclosed technology. The draw string can run a length of the hollow portal and exit from extreme ends thereof.

The removably connectable cords each have, in embodiments of the disclosed technology, one end with a removable clip, which is attached to the fabric sheet in the step of connecting. Another end can further be removably connectable or connected to the cord. The removably connectable cords, in embodiments of the disclosed technology, can each have one end with a removable clip, which is attached to the fabric sheet in the step of connecting, and another end which is fixedly and permanently connected to the cord.

In embodiments, a further step of connecting opposite ends of the cord to each other via a fastening mechanism before the step of pulling is also claimed.

A kit for covering a bed with a fabric sheet includes an elastic cord with draw string extending within an elastic layer and fabric layer of the cord, and a plurality of removable cords attached perpendicularly to the elastic cord, each having a connector at at least one end. The elastic cord with draw string is sized to fit around sides of a pre-determined sized bed in a first condition, and sized to be smaller than the sides of the pre-determined sized bed in a second condition. Pulling the draw string out of the elastic cord causes the elastic cord to change in size from the first condition to the second condition.

The plurality of removable cords, in some embodiments, each have clamps which removably attach to other objects, including one at a first end removably attached to the elastic cord, and a second, at a second opposite end from the first end, removably attached to the fabric sheet. In other embodiments, the plurality of removable cords each has clamps which removably attach, including one at a first end removably attached to the fabric sheet, and the clamp further having a permanent connection to the elastic cord at a second opposite end thereof.

The elastic cord can have fasteners on extreme ends thereof which fasten to each other. Each of the plurality of removable cords can have a snap fastener. The snap fasteners can be fixedly attached or removably attached to the elastic cord. The elastic cord itself can be fixedly attached in a queen size, full size, or twin size, Olympic queen, king, or California king size ring structure. In other embodiments, the elastic cord is removably attachable/detachable at a portion thereof.

"Substantially" and "substantially shown," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

The technology disclosed includes a cord with an outer fabric covering over a sheath and draw string. The sheath and/or fabric and/or cord, in general, can be of elastic material (defined as stretchable and compressible from a first length to at least a length double the first length, without losing structural integrity). The cord has a series of clips attached there-to (removably or irremovably) by a second cord or by direct attachment. The clips are in turn removably attachable to edges of a sheet while the sheet is unconnected to, partially on, or fully on the surface and/or sides of the mattress. "Removable," for purposes of this disclosure, is defined as "able to repeatedly attach and detach more than 30 times without losing structural integrity or the ability to continue to attach and detach." Similarly, "irremovable" is defined as "unable to detach without causing destruction to at least some of the materials being detached, such as by cutting, tearing, or removing stitching." One then tightens the draw string, reducing the length of the cord, and continues to do so until the sheet is pulled to a bottom side of the mattress. In this manner, the sheet ends are beneath the mattress and tightened thereto by the cord.

Embodiments of the disclosed technology will become clearer in view of the following discussion of the figures.

Figure 1:
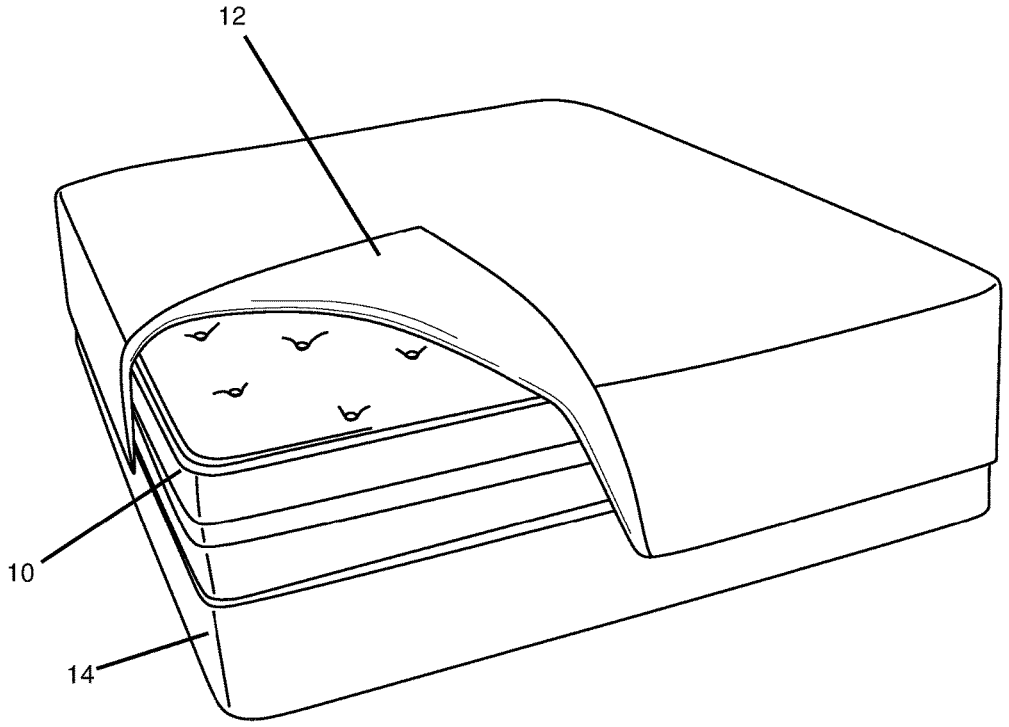
FIG. 1 shows a top perspective view of a bed with sheet, in an embodiment of the disclosed technology.

FIG. 1 shows a top perspective view of a bed with sheet, in an embodiment of the disclosed technology. Here, the mattress 10 has right, left, front, and back sides, as well as top and bottom sides. A rectangular mattress is shown, though it should be understood that a mattress of any size or shape is within the scope of the disclosed technology. The sheet 12 shown is an unfitted sheet draping over at least some of the sides of the mattress 10. The mattress 10 rests on a bed base 14, such as a box spring or other support for the mattress situated between the mattress and the floor.

Figure 2:
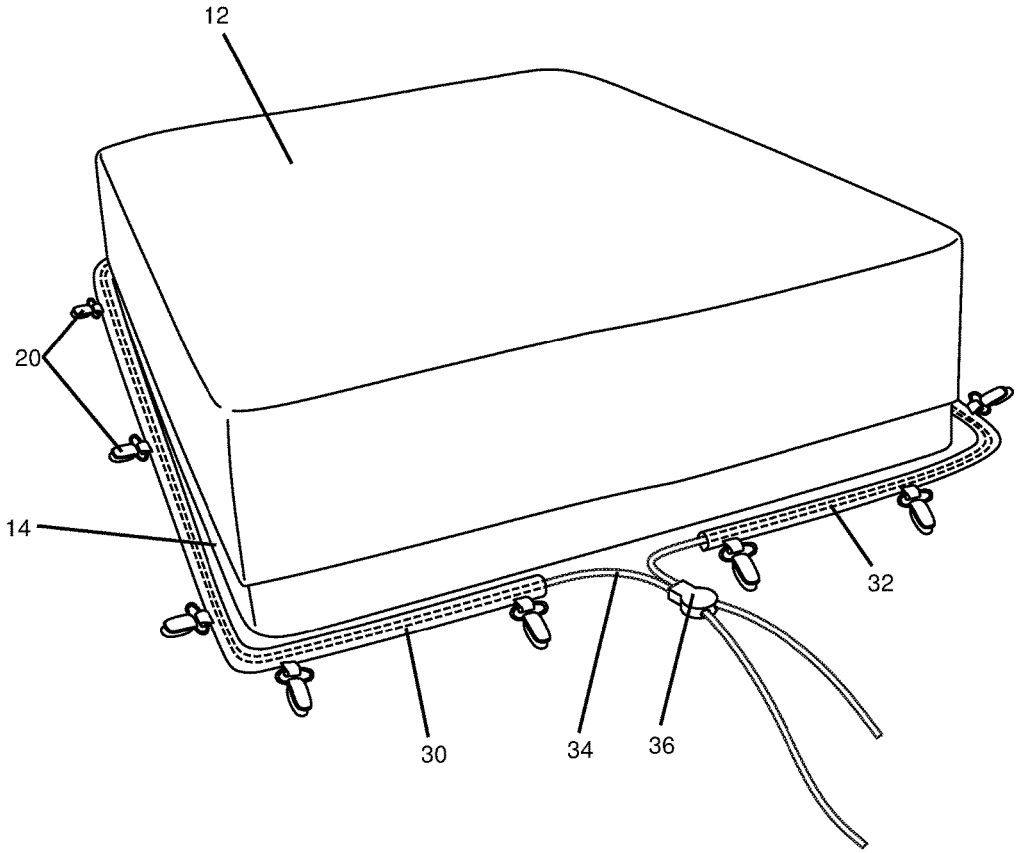
FIG. 2 shows the bed with sheet of FIG. 1, with a draw string cord placed around the perimeter of the bed.

FIG. 2 shows the bed with sheet of FIG. 1, with a draw string cord placed around the perimeter of the bed. The mattress is hidden from view below the sheet 12, which is shown falling on each respective side of the bed. That is, the sheet is placed primarily (mostly) over the top side, with portions hanging down over the left, right, front, and back sides of the mattress situated atop bed base 14. The draw string 34 is shown passing through the portal 32 in the cord 30. The portal runs the length of, and extends through, the cord 30. The cord 30 can be attached at a meeting point or juncture 36 which frictionally grasps the cord and allows one to pull the cord 30 there-through in one or both directions (decreasing or increasing the length of cord passed through the juncture 36), but in a resting position (defined as, "without human forces or human-directed forces acting thereon"), retaining a present position along the cord 30. The cord 30, the draw string 34, and/or the sheath/portal 32 can each be elastic. In this manner, the cord 30 decreases from a fully stretched out length to a lesser length from end to end while in a resting position. Thus, one stretches the cord to fit around the sides of a mattress and then decreases it in length to snugly fit and remain frictionally attached at the sides of the mattress. The clips 20 will be discussed in detail with reference to FIG. 3.

Figure 3:
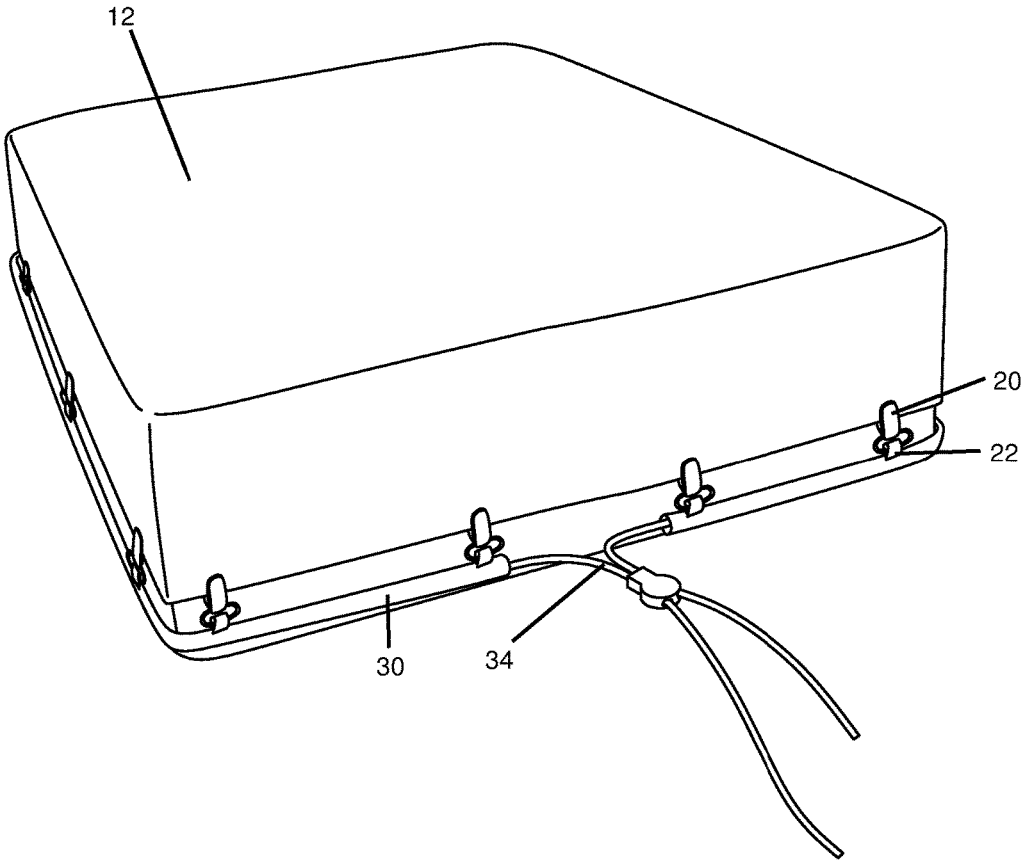
FIG. 3 shows the bed with sheet of the prior figures, with the draw string cord attached to the sheet.

FIG. 3 shows the bed with sheet of the prior figures, with the draw string cord attached to the sheet. Here, note that the clips 20 are on each side (top, left, right, bottom) of the mattress, with at least one per side. The opposite perspective view of the mattress and clips is a mirror image of what is shown, with the exception of the portion where the two ends of the cord 34 come together. In the opposite perspective view, the cord 30 is continuous without an opening in the sheath, in embodiments of the disclosed technology. The clips 20 have a length of fabric, elastic material, and/or elongated members, which are fixedly and/or irreversibly attached to the length of cord 30. In other embodiments, the clips 20 are detachable from the cord 30, such as by way of a removable clip or snap connector. In any case, the clips 20 are removably attached to the bed sheet 12 on each side, and the draw string 34 is ready to be tightened.

Figure 4:
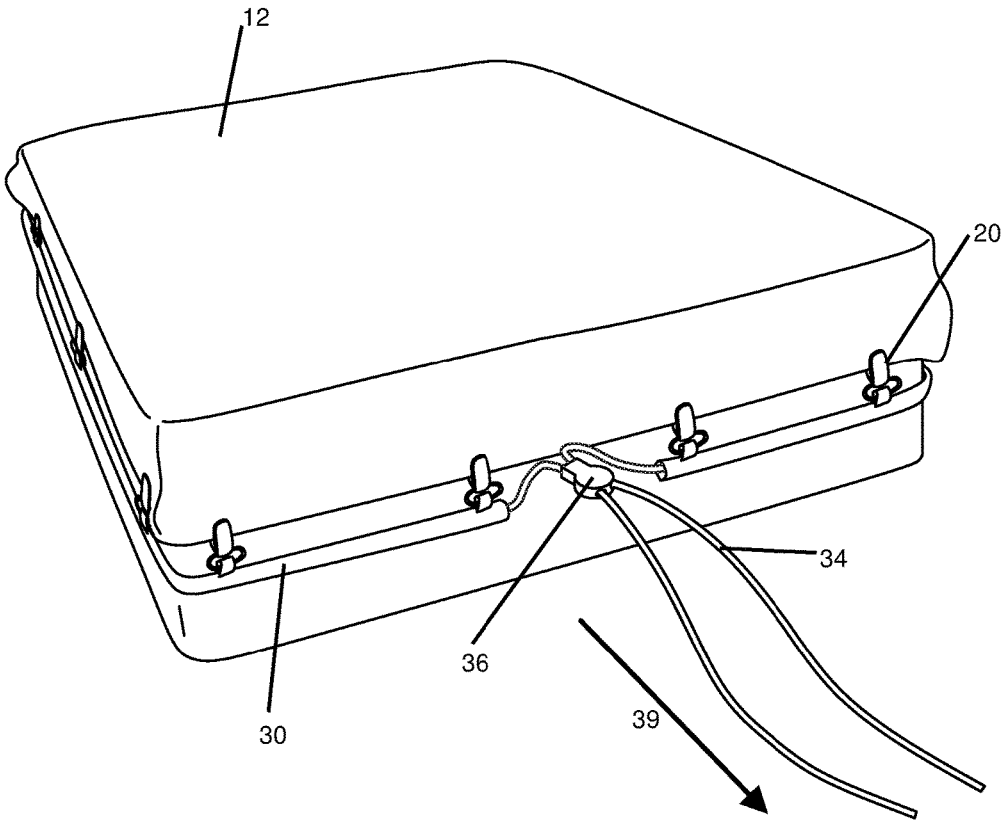
FIG. 4 shows the bed with sheet of FIG. 3, with the draw string being tightened.

FIG. 4 shows the bed with sheet of FIG. 3, with the draw string being tightened. The draw string 34 is tightened by pushing the juncture 36 closer to the bed while pulling the ends of the string away from the mattress in the direction 39 shown in the figure. This causes the cord 30 to decrease in length as the draw string 34 is pulled out there-from. The direction 39 comprises also a downward vector, in embodiments of the disclosed technology. That is, in addition to being pulled in a direction directly away from the side of the bed, it is pulled down towards the floor on which the mattress 10 rests, at least slightly. Defining zero degrees as a pull directly horizontal and away from (perpendicular to) the side of the mattress 10, the downward pull is in a direction of −5, −15, −25, −30, or −45 degrees with respect thereto.

It should further be understood that the sheet 12 can be either a fitted or a non-fitted sheet, in different embodiments of the disclosed technology. When using a fitted sheet, one places the fitted sheet in a manner such that its elastic holds the sheet to each side of the mattress, as shown in FIG. 4. This can be covering half of each side. One then pulls the draw string 34 in the direction 39, as described in the preceding paragraph, and the fitted sheet (or non-fitted sheet) moves downward to cover the entire sides of the bed, and then at least a portion of the bottom of the mattress.

Figure 5:
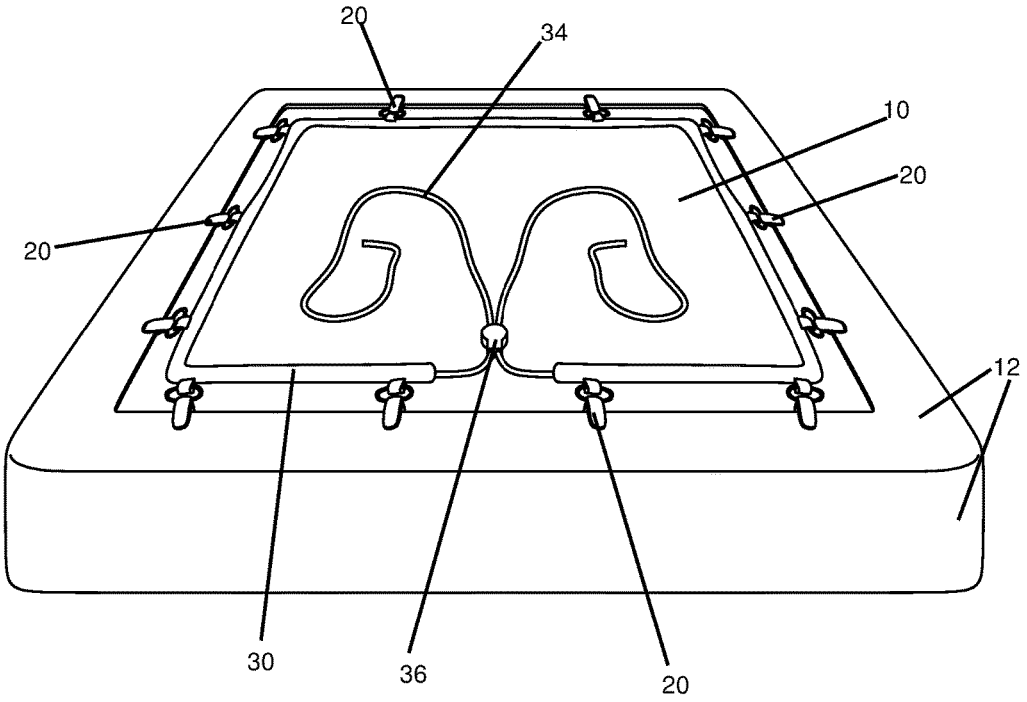
FIG. 5 shows a bottom perspective view of the bed with tightened sheet and draw string, in an embodiment of the disclosed technology.

FIG. 5 shows a bottom perspective view of the bed with tightened sheet and draw string, in an embodiment of the disclosed technology. The sheet 12 has been pulled over the entirety of the sides of the mattress 10, as well as at least a portion of the bottom of the mattress adjacent to (defined as "closest to") each side thereof. The clips 20 remain attached to the sheet 12 as well as to the cord 30.

Figure 6:
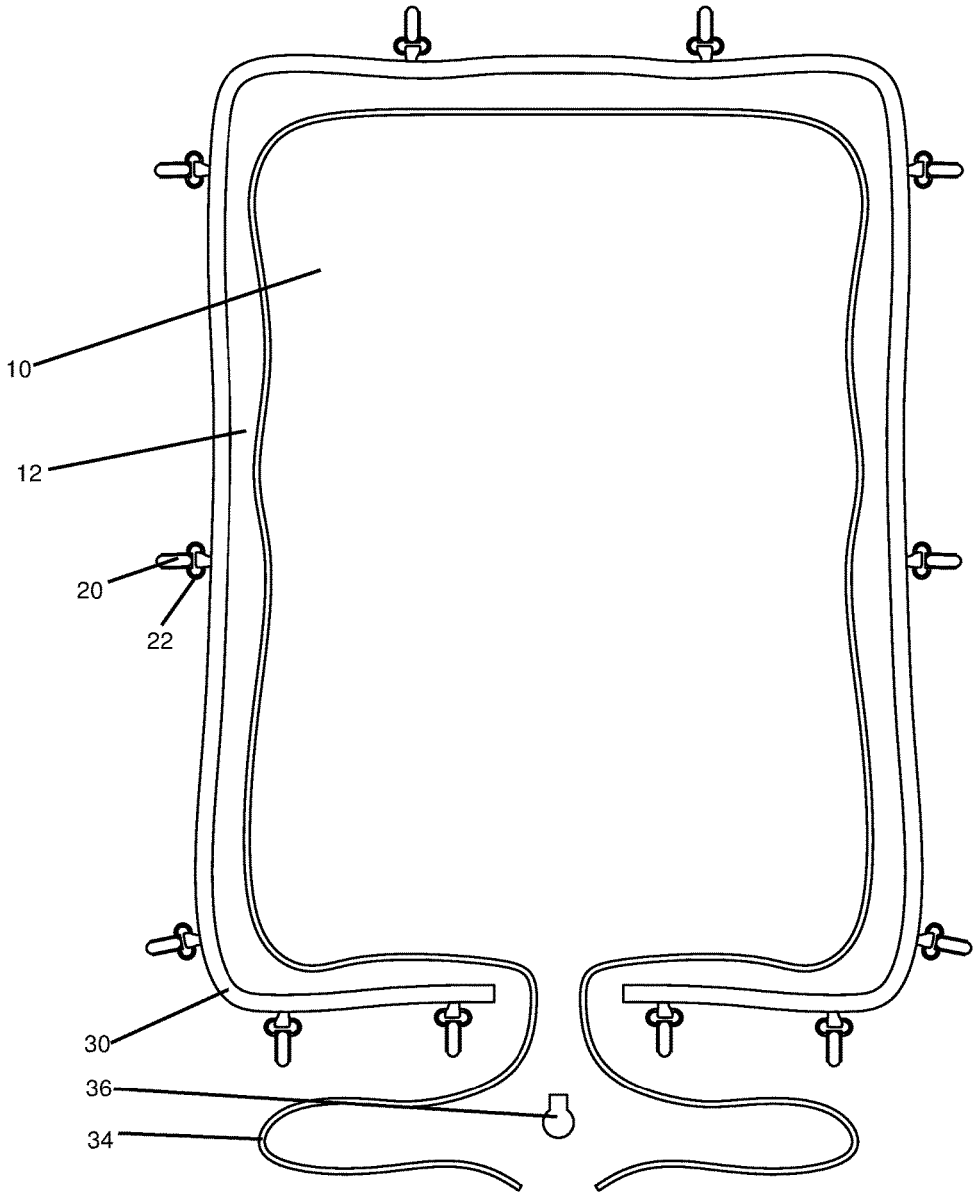
FIG. 6 shows the separate items used with embodiments of the disclosed technology.

FIG. 6 shows the separate items used with embodiments of the disclosed technology. Here, one sees the draw string 34 in its entirety, its length being greater than that of the cord 30 into which it fits. The clips 20 are attached removably or irremovably via material 22 to the cord 30.

Figure 7:
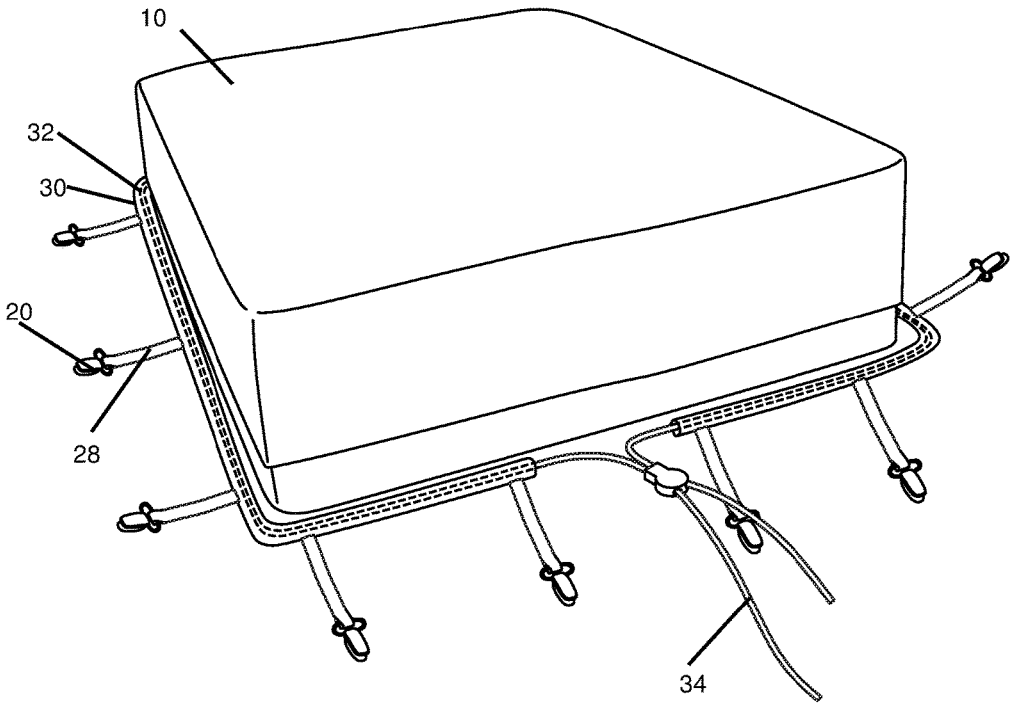
FIG. 7 shows an alternative embodiment of the string cord with cords attached thereto, in an embodiment of the disclosed technology.

FIG. 7 shows an alternative embodiment of the string cord with cords attached thereto, in an embodiment of the disclosed technology. Here, the clips 20 are connected to the cord 30 via a connecting region or further cord 28. The cord 28 shown is irremovably connected to the cord 30.

Figure 8:
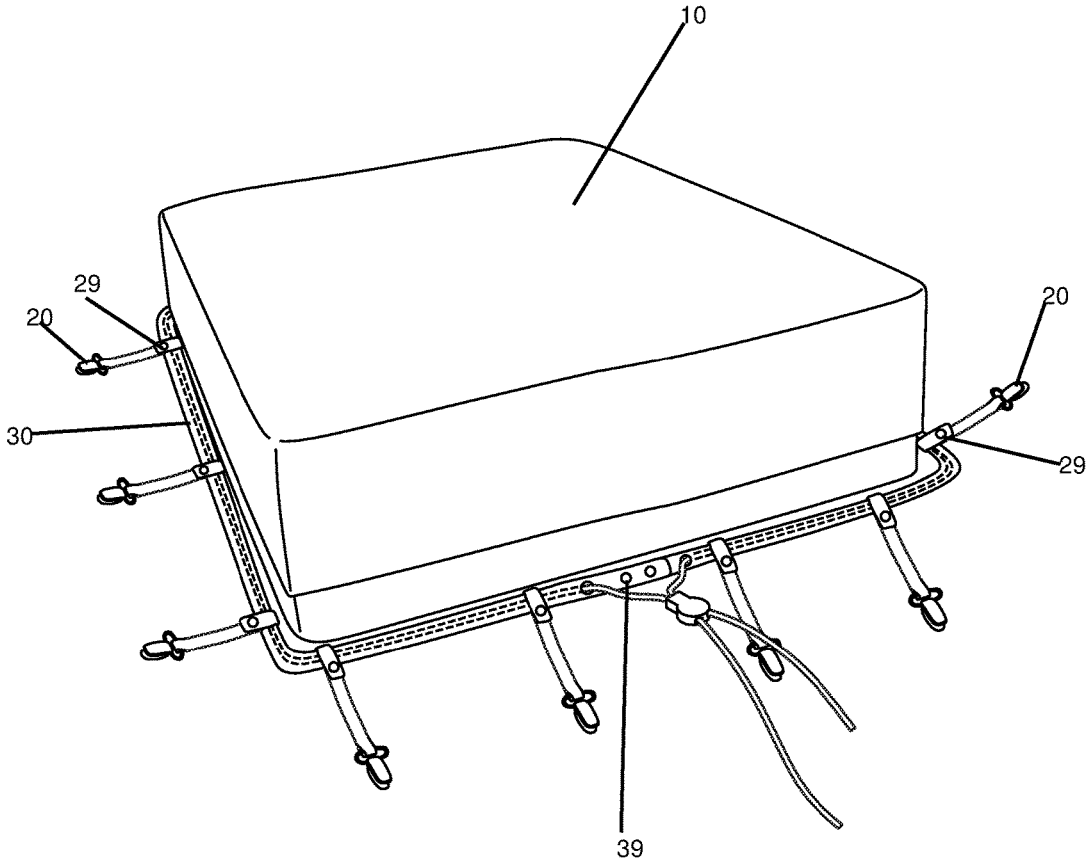
FIG. 8 shows a second alternative embodiment of the string cord with cords snapped thereto, in an embodiment of the disclosed technology.

FIG. 8 shows a second alternative embodiment of the string cord with cords snapped thereto, in an embodiment of the disclosed technology. Here, snaps 29 connect the clips 20 to the cord 30. The cord 30 can further be fastened to itself via snaps 39. This is readily seen when compared to the version shown in FIG. 7. In FIG. 7, note that the inner string 34 exits from ends of the cord 30. In the version shown in FIG. 8, the cord itself snaps together, forming a complete closed loop around the bed 12, under the sheet 10. The string 34, instead, exits from portals in the cord. This allows for a more aesthetically pleasing and, in some cases, structurally sound, configuration.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A method of covering an object of any size or shape, the object having a top side, bottom side opposite said top side, and a side situated between said bottom and said top side herein referred to as a between side, comprising the steps of:

placing a fabric sheet on said top side of said object, with at least some of said fabric sheet draped over said between side;

wrapping a continuous cord enclosing a draw string around or under said object, at least a portion of said draw string extending through a hollow portal in said continuous cord;

connecting said fabric sheet to said continuous cord via a plurality of spaced apart removable cords, with at least one spaced apart removable cord between a majority of each of two edges of said object; and pulling at least a portion of said draw string out of said hollow portal in said continuous cord, causing said continuous cord to decrease in length such that said connected fabric sheet more completely and tightly covers said between side of said object.

2. The method of covering an object of claim 1, wherein said step of pulling continues until said continuous cord is completely adjacent to a bottom side of said object.

3. The method of covering an object of claim 2, wherein said step of pulling further continues until said fabric sheet covers at least a portion of said bottom side of said object.

4. The method of covering an object of claim 1, wherein said continuous cord comprises an outer fabric layer covering an elastic layer which, in turn, covers said hollow portal and said draw string runs a length of said hollow portal.

5. The method of covering an object of claim 1, wherein each cord of said plurality of removable of spaced apart removable cords comprises a removable clip at one end thereof, which is attached to said fabric sheet in said step of connecting and further comprises another end which is removably connectable to said continuous cord.

6. The method of covering an object of claim 1, wherein each cord of said plurality of removable cords comprises a removable clip at one end thereof, which is attached to said fabric sheet in said step of connecting, and further comprises another end which is fixedly and permanently connected to said continuous cord.

7. The method of covering an object of claim 1, further comprising a step of connecting opposite ends of said continuous cord to each other via a fastening mechanism, before said step of pulling.

8. The method of covering an object of claim 1, wherein more completely is totally completely, such that an entirety of said between side is covered by said fabric sheet.

9. A kit for covering and securing a fabric sheet upon an object of any size or shape, comprising:

an elastic cord with a draw string extending within an elastic layer and a fabric layer of said cord, at least a portion of said draw string further extending through at least one hollow portal in said elastic cord;

a plurality of removable cords attached perpendicularly to said elastic cord, each removable cord having a connector located at an end thereof, the connectors each being removably attachable to said fabric sheet;

wherein, in a first condition, said fabric sheet overlies said object and edges of said fabric sheet are at sides of said object and wherein said elastic cord with said draw string is sized to extend beyond a perimeter defined by said object such that the connectors engage the sheet;

wherein pulling said draw string out of said at least one hollow portal in said elastic cord causes a transition from said first condition to a second condition; and wherein, in a second condition with said fabric sheet overlying said object and said connectors attached to said fabric sheet, said elastic cord with said draw string and at least portions of said fabric sheet are located relatively lower around said object than in said first condition, the length of the elastic cord being shorter in the second condition than in the first condition.

10. The kit of claim 9, wherein each cord of said plurality of removable cords has clamps including one at a first end removably attached to said elastic cord and a second at a second opposite end from said first end removably attached to said fabric sheet.

11. The kit of claim 9, wherein each cord of said plurality of removable cords has a clamp at a first end removably attached to said fabric sheet and, at a second opposite end thereof, a permanent connection to said elastic cord.

12. The kit of claim 9, wherein said elastic cord comprises fasteners at extreme ends thereof which fasten to each other.

13. The kit of claim 12, wherein said plurality of removable cords each comprise a snap fastener.

14. The method of claim 1, wherein said step of connecting said fabric sheet to said cord is carried out before said step of placing said fabric sheet on said top side of said object.

15. The method of claim 14, wherein said fabric sheet is fitted.

16. The method of claim 14, wherein said fabric sheet is unfitted.

17. The kit of claim 9, wherein said elastic cord comprises fasteners at extreme ends thereof which are configured to fasten to each other.

18. A kit for covering and securing a pre-determined sized object with a fabric sheet, comprising:

an elastic cord with a draw string extending within an elastic layer and a fabric layer of said cord, at least a portion of said draw string further extending through at least one hollow portal in said elastic cord;

a plurality of removable cords attached perpendicularly to said elastic cord, each removable cord having a connector located at an end thereof, the connectors each being configured to removably attach to said fabric sheet;

wherein, in a first condition, said fabric sheet overlies said object and edges of said fabric sheet are overly proximate sides of said object and wherein said elastic cord with said draw string is sized to extend beyond a perimeter defined by said object such that the connectors may engage the sheet;

wherein pulling said draw string out of said at least one hollow portal in said elastic cord causes a transition from said first condition to a second condition; and wherein, in a second condition with said fabric sheet overlying said object and said connectors attached to said fabric sheet, said elastic cord with said draw string and at least portions of said fabric sheet are located below said object, the length of the elastic cord being shorter in the second condition than in the first condition.

* * * * *